US005296016A

United States Patent [19]

Yoshimura et al.

[11] Patent Number: 5,296,016

[45] Date of Patent: Mar. 22, 1994

[54] SURFACE COATED CERMET BLADE MEMBER

[75] Inventors: Hironori Yoshimura; Seiichirou Nakamura; Niro Odani, all of Ishige, Japan

[73] Assignee: Mitsubishi Materials Corporation, Tokyo, Japan

[21] Appl. No.: 761,402

[22] Filed: Sep. 17, 1991

[30] Foreign Application Priority Data

Dec. 25, 1990 [JP] Japan ..... 2-418976

[51] Int. Cl.[5] ..... C22C 29/04

[52] U.S. Cl. ..... 75/238; 75/230; 75/245; 75/246; 428/545; 428/547

[58] Field of Search ..... 419/10, 13, 19, 11, 419/14, 15, 16, 17, 18, 38; 428/547, 552, 610, 614, 545; 75/230, 238, 245, 246

[56] References Cited

U.S. PATENT DOCUMENTS

| | | | |
|---|---|---|---|
| 4,047,897 | 9/1977 | Tanaka | 428/539.5 |
| 4,447,263 | 5/1984 | Sugizawa et al. | 75/233 |
| 4,514,224 | 4/1985 | Nishigaki | 75/238 |
| 4,563,215 | 1/1986 | Yamamoto et al. | 75/238 |
| 4,830,930 | 5/1989 | Taniguchi et al. | 428/547 |
| 4,902,395 | 2/1990 | Yoshimura et al. | 204/192.3 |
| 4,935,057 | 6/1990 | Yoshimura et al. | 75/238 |
| 5,041,261 | 8/1991 | Buljan et al. | 419/11 |
| 5,059,491 | 10/1991 | Odani et al. | 428/614 |
| 5,075,181 | 12/1991 | Quinto et al. | 428/698 |
| 5,149,361 | 9/1992 | Iyori et al. | 75/233 |

FOREIGN PATENT DOCUMENTS

| | | |
|---|---|---|
| 0247985 | 4/1987 | European Pat. Off. . |
| 0344421 | 3/1989 | European Pat. Off. . |
| 0392519 | 4/1990 | European Pat. Off. . |
| 269525 | 5/1992 | European Pat. Off. . |
| 0143889 | 4/1984 | Fed. Rep. of Germany . |
| 1357903 | 5/1963 | France . |
| 2214546 | 1/1974 | France . |
| 56-62960 | 5/1981 | Japan . |
| 2-04972 | 1/1990 | Japan . |
| 2-22453 | 1/1990 | Japan . |

*Primary Examiner*—Donald P. Walsh
*Assistant Examiner*—Daniel Jenkins
*Attorney, Agent, or Firm*—Thomas R. Morrison

[57] ABSTRACT

There is disclosed a surface coated cermet blade member which includes a cermet substrate and a hard coating of an average thickness of 0.5 to 20 μm formed thereon. The substrate contains, apart from unavoidable impurities, a binder phase of 5 to 30% by weight of at least one of cobalt, nickel, iron and aluminum, and a hard dispersed phase of a balance carbo-nitride of metals. The metals are titanium, tungsten and at least one of tantalum, niobium, vanadium, zirconium, molybdenum and chromium. The substrate includes a surface portion having a hardness greater than an interior portion. The hard coating may be composed of one or more coating layers. Each coating layer is formed of TiX or $Al_2O_3$, where X denotes at least one element of carbon, nitrogen, oxygen and boron.

18 Claims, 2 Drawing Sheets

SURFACE COATED CERMET BLADE MEMBER

BACKGROUND OF THE INVENTION

1. Field of the Invention

The present invention relates to surface-coated cermet blade members, and particularly, those which exhibit excellent wear resistance in high-speed cutting operations and superior fracture resistance in interrupted cutting operations.

2. Prior Art

Known surface coated cermet blade members comprise:

a cermet substrate which consists, apart from unavoidable impurities, of a binder phase of one or more iron family metals such as cobalt (Co) or nickel (Ni), and a hard-dispersed phase of balance carbo-nitride represented by the formula (Ti,M)(C,N), wherein M denotes one or more elements selected from tantalum (Ta), niobium (Nb), vanadium (V), zirconium (Zr), tungsten (W), molybdenum (Mo) and chromium (Cr); and a hard coating of an average thickness of 0.5 to 20 μm formed on the surface of the substrate, the hard coating being composed of a single layer of TiX or of $Al_2O_3$, or of multiple layers of TiX or $Al_2O_3$, wherein X denotes one or more elements selected from carbon (C), nitrogen (N), oxygen (O) and boron (B).

For example, Japanese Patent Application First Publication, Serial No. 53-131910 describes a cermet with a hard coating which has an average thickness of 0.5 to 20 μm and is composed of a single layer of a titanium compound such as TiCO or TiCNO, or of $Al_2O_3$, or of multiple layers of titanium compounds and/or $Al_2O_3$. Another Japanese Patent Application First Publication, Serial No. 56-62960 describes a surface-coated cermet in which a hard coating, composed of a single layer of a titanium compound such as TiN or TiCN, or of $Al_2O_3$, or of multiple layers of titanium compounds and/or $Al_2O_3$, is deposited on the surface of the cermet substrate through a TiC intermediate layer containing binder phase constituents distributed therein. Yet another Japanese Patent Application First Publication, Serial No. 63-134654 describes a hard coating composed of a single layer of a titanium compound such as TiC, TiN or TiCN, or of multiple layers of titanium compounds, the titanium compounds being in the form of grains having an average particle size of no greater than 0.5 μm. However, the surface coated cermets disclosed in these three references have the disadvantages that since the bonding strength between the hard coating and the cermet substrate is low, the hard coating is susceptible to separation, resulting in short tool life.

Furthermore, in Japanese Patent Application First Publication, Serial No. 2-4972, there is disclosed a surface coated blade member which comprises a cermet substrate having a surface portion composed only of hard-dispersed phase constituents, and has a hard coating deposited thereon, composed of a single layer of a titanium compound such as TiC, TiN or TiCN, or of multiple layers of titanium compounds. However, since no binder phase constituents exist in the surface portion of the cermet substrate, the blade member is susceptible to fracture.

Moreover, Japanese Patent Application First Publication, Serial No. 2-22455 discloses a surface coated cermet blade member which comprises a cermet substrate in which the ratio C/C+N is greater at the surface portion than at interior portions, and a hard coating which is composed of a single layer of a titanium compound such as TiC, TiN or TiCN, or of multiple layers of titanium compounds. However, this blade member is also inferior in fracture resistance because the carbon content is great at the surface portion.

Thus, although various types of surface-coated cermet blade members have been developed in recent years, their ability to withstand higher cutting speed and the increasingly severe demands of the interrupted cutting operations have not kept pace with the requirements imposed by attempts to reduce labor over head and to improve efficiency. The prior art cermet blade members as described above lack sufficient wear resistance during high-speed cutting operations and are not sufficiently resistant to fracturing during interrupted cutting operations, as a result of which, tool life is reduced.

SUMMARY OF THE INVENTION

It is therefore the object of the present invention to provide a surface coated cermet blade member which exhibits excellent performance even when used for high-speed cutting and interrupted cutting operations under severe conditions.

According to the invention, there is provided a surface coated cermet blade member comprising:

a substrate of cermet which consists, apart from unavoidable impurities, of a binder phase of 5 to 30% by weight of at least one element selected from the group consisting of cobalt, nickel, iron and aluminum, and a hard dispersed phase of a balance carbo-nitride of metals, the metals being titanium, tungsten and at least one additional metal selected from the group consisting of tantalum, niobium, vanadium, zirconium, molybdenum and chromium, the substrate including a surface portion of less than 1 mm deep from a surface thereof and an interior portion of no less than 1 mm deep from the surface, the surface portion having greater hardness than said interior portion; and a hard coating of an average thickness of 0.5 to 20 μm deposited on the substrate, the hard coating being composed of at least one coating layer formed of a coating compound selected from the group consisting of TiX and $Al_2O_3$, where X denotes at least one element selected from the group consisting of carbon, nitrogen, oxygen and boron.

DETAILED DESCRIPTION OF THE INVENTION

Figure 1:
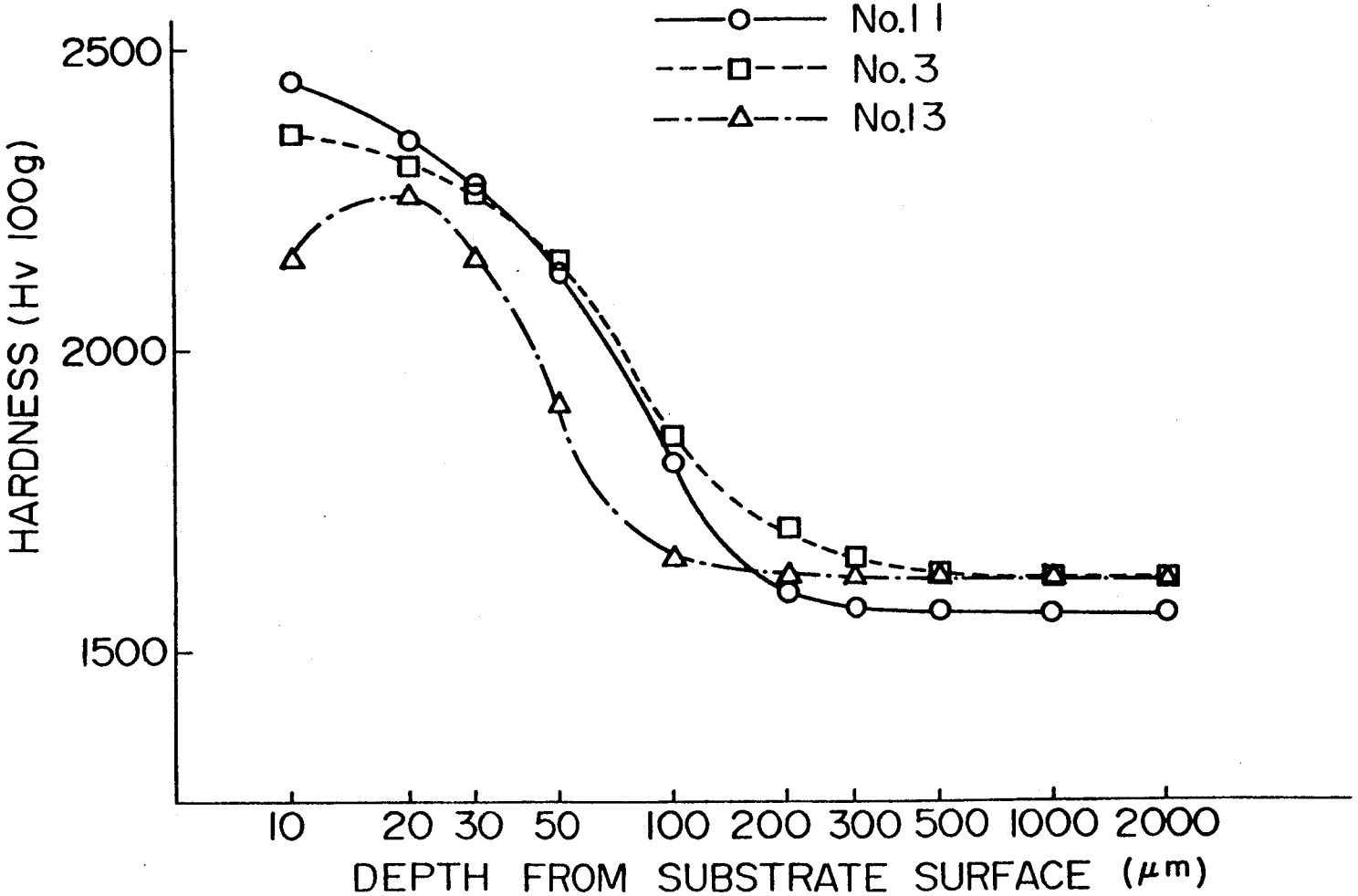
FIG. 1 is a graphical representation showing a relationship between the depth from a substrate surface and the Vickers hardness regarding surface coated blade members of the present invention.

The inventors have made an extensive study in order to obtain a surface coated cermet blade member which meets the requirements as described above. As a result, they have come to know that when the hardness of the portion of the cermet substrate near the substrate surface is enhanced so as to be greater than the interior portion inside the surface portion, the bonding strength between the hard coating and the hard surface portion can be enhanced and the resulting surface coated blade member has extremely high fracture and wear resistances in high-speed cutting and interrupted cutting operations under very severe conditions.

The present invention is based on the above findings, and provides a surface coated cermet blade member which comprises a cermet substrate consisting, apart from unavoidable impurities, of a binder phase of 5 to 30% by weight of at least one element selected from the group consisting of cobalt, nickel, iron and aluminum, and a hard dispersed phase of a balance composite carbo-nitride of metals, the metals being titanium, tungsten and at least one additional metal selected from the group consisting of tantalum, niobium, vanadium, zirconium, molybdenum and chromium, the substrate including a surface portion having greater hardness than the interior portion, and, a hard coating formed on the cermet substrate having an average thickness of 0.5 to 20 μm and is composed of a single coating layer of TiX or $Al_2O_3$ or of plural coating layers of TiX and/or $Al_2O_3$, where X denotes at least one element selected from the group consisting of carbon, nitrogen, oxygen and boron.

In the foregoing, the term "a surface portion" is defined as a portion near the surface of the cermet substrate which is less than 1 mm, preferably less than 100 μm deep from the surface thereof, while the term "an interior portion" is defined as a portion inside the surface portion which is no less than 1 mm deep from the surface. The hardnesses for the surface portion and the interior portion can be measured using Vickers or Rockwell hardness tester after having determined the measuring points.

The surface coated blade member of the aforesaid construction is produced by first preparing a green compact which contains, apart from unavoidable impurities, 5 to 30% by weight of at least one binder phase constituent selected from the group consisting of cobalt, nickel, iron and aluminum, and a balance hard dispersed phase constituent of metal carbo-nitride. The green compact is heated from room temperature to an elevated temperature of 1,100° to 1,400° C. in a vacuum. Subsequently, nitrogen gas is introduced at the above temperature range, and the sintering operation is effected in the nitrogen atmosphere at such a reduced pressure that the substrate surface is denitrified, i.e., at a nitrogen partial pressure of 5 to 100 torr. Then, the last stage of the sintering operation and the subsequent cooling operation are carried out in a non-oxidizing atmosphere such as a vacuum or an inert gas atmosphere. With these procedures, a cermet substrate, of which surface portion has hardness greater than the interior portion, can be successfully obtained. The cermet substrate thus formed is then coated by means of chemical vapor deposition (CVD) or physical vapor deposition (PVD) to form a hard coating of one or more layers of the aforesaid compositions.

In the foregoing, when the sintering operation is effected in nitrogen atmosphere at a suitably reduced pressure so that the substrate surface is denitrified, and the subsequent cooling operation is carried out in a non-oxidizing atmosphere such as a vacuum or an inert gas atmosphere, the surface portion of the resulting cermet substrate comes to have less binding metals such as cobalt or nickel but more tungsten compared with the interior portion, this tungsten having higher strength than titanium. Therefore, in the resulting surface coated blade member, the bonding strength between the hard coating and the hard surface portion of the substrate can be enhanced, and the fracture and wear resistances greatly increased. Furthermore, in the case where the sintering operation is effected in a less denitrifying atmosphere, e.g., atmosphere of higher nitrogen pressure or of lower sintering temperature, prior to the cooling operation in a non-oxidizing atmosphere, a thin surface layer composed only of core structures free from surrounding structures may exist at an outermost portion which is no greater than 10 μm deep. In such a case, the binding metal phase is rich in the above outermost portion and becomes the lowest immediately beneath the outermost portion in the surface portion, while the amount of the binding phase at the interior is close to that of the blended mixture before the sintering. Thus, strictly speaking, it is presumably considered that the hardness is low at the outermost surface portion but the greatest immediately beneath the outermost portion in the surface portion, and the interior portion has the hardness which the cermet substrate intrinsically possesses. However, even though the outermost portion has a significant binding metal phase and is low in hardness, the blade member has high fracture and wear resistances because the thickness of the outermost portion is very thin and the surface portion beneath the outermost portion has the greatest hardness.

Furthermore, when the cooling speed in vacuum is decreased, the binding metal phase may effuse on the cermet surface to a thickness of 0.5 to 3 μm. However, even in this case, the cobalt distribution and the hardness gradient are the same as described above, so that the purposes of the invention can be adequately attained.

In addition, the cermet substrate obtained by the sintering operation as described above may be ground prior to the chemical or physical vapor deposition of hard coating. Furthermore, in the case where the physical vapor deposition process is applied, metal titanium may be coated on the substrate prior to the coating of TiC, TiN, TiCN and so on. In this case, the thickness of the metal titanium layer should be preferably no greater than 1 μm.

Furthermore, in the case where the chemical vapor deposition process is applied, it is preferable that the coating is carried out at low temperature. This is because the binding metal in the substrate diffuses into the hard coating when the coating is carried out at high temperature, so that the wear resistance is unduly lowered.

Moreover, in the surface coated cermet blade member in accordance with the present invention, it is necessary to include 5 to 30% by weight of at least one element selected from the group consisting of cobalt, nickel, iron and aluminum as a binder phase constituent. However, in order to balance the wear and fracture resistances, it is preferable that the amount of the above element should be from 10 to 20% by weight. Similarly, although the average thickness of the hard coating is determined so as to be from 0.5 to 20 μm, it is preferable that it ranges from 2 to 10 μm. The bonding strength of the hard coating is influenced by the cermet substrate, especially by the hardness of the surface portion of the substrate, and it is preferable that the hardness of the surface portion be close to the hardness of the hard coating, which is composed of a single layer of titanium compound such as TiC, TiN or TiCN, or of $Al_2O_3$, or of multiple layers of titanium compound such as TiC, TiN or TiCN, and/or $Al_2O_3$. When the hardness of the surface portion of the cermet substrate is low, there occurs discontinuity in hardness. Therefore, when the blade member undergoes an impact during the cutting operation such as interrupted cutting, the surface portion of the cermet substrate is deformed, and the hard coating becomes separated from the substrate. Furthermore, if the hardness of the interior portion of the substrate is unduly great, the toughness becomes insufficient, resulting in lowering of the resistance to propagation of cracks. Therefore, when used under severe cutting conditions such as in interrupted cutting, the blade member is unfavorably subjected to fracture. For these reasons, it is preferable that the maximum Vickers hardness at a load at 100 g in the surface portion of the substrate is no less than 2000 while Vickers hardness in the interior portion thereof is less than 2000. In addition, it is preferable that the hardness of the surface portion is the maximum between the substrate surface and a depth of 100 μm.

As described above, the surface coated blade member in accordance with the present invention exhibits excellent wear and fracture resistances even when used in continuous and interrupted cutting operations under severe cutting conditions, and hence can be put into practical use for a prolonged period of time.

The present invention will now be described in detail with reference to the following examples.

EXAMPLE 1

Starting powders of TiCN, TiC, TiN, TaC, NbC, WC, $Mo_2C$, VC, Co, Ni and NiAl were prepared, each of which had an average particle size of 1.5 μm. These powders were blended in various blend compositions depicted in Tables 1 and 2 and were subjected to wet mixing in a ball mill for 72 hours. After being dried, the mixtures were pressed into green compacts under a pressure of 1.5 ton/cm$^2$, and the green compacts were sintered under the sintering conditions set forth in Tables 3 and 4 to produce cermet substrates A to M and a to m. Subsequently, the cermet substrates were coated with hard coatings as set forth in Tables 5 and 6 by means of coating methods shown in the same Tables to produce surface coated blade members 1 to 14 of the invention and comparative surface coated blade members 1 to 14.

Then, as to each of the above blade members, the hardness of the surface portion at a portion 20 μm deep from the substrate surface and at the interior portion 1 mm deep from the substrate surface were measured using Vickers hardness tester under a load of 100 g. The results are shown in Tables 7 and 8.

Furthermore, as to the surface coated blade members 3, 11 and 13 of the invention and the comparative surface coated blade members 3, 11 and 13, the Co, Ni and W contents were measured at the surface portion 20 μm deep from the substrate surface and at the interior portion 1 mm deep from the substrate surface. The results are shown in Table 9.

In addition, the structure of each blade member was observed. In the observation of the blade member 3 of the invention, it was found that the binding metals such as Co or Ni were exuded immediately beneath the hard coating, i.e., on the surface of the cermet substrate. The hard-dispersed phase was somewhat coarse at the surface portion compared with that at the interior portion. As to the blade member 11 of the invention, the hard dispersed phase of the surface portion was more coarse than that of the interior portion. In the blade member 13 of the invention, an outermost portion composed only of core structures free from surrounding structures was found immediately under the hard coating, i.e., on the substrate surface, in a thickness of 2 to 3 μm, and the hard dispersed phase beneath the outermost portion was more coarse than the interior portion.

With respect to each of the comparative blade members 3, 11 and 13, although the substrate surface was somewhat uneven, there was no significant difference in structure between the surface portion and the interior portion.

Figure 2:
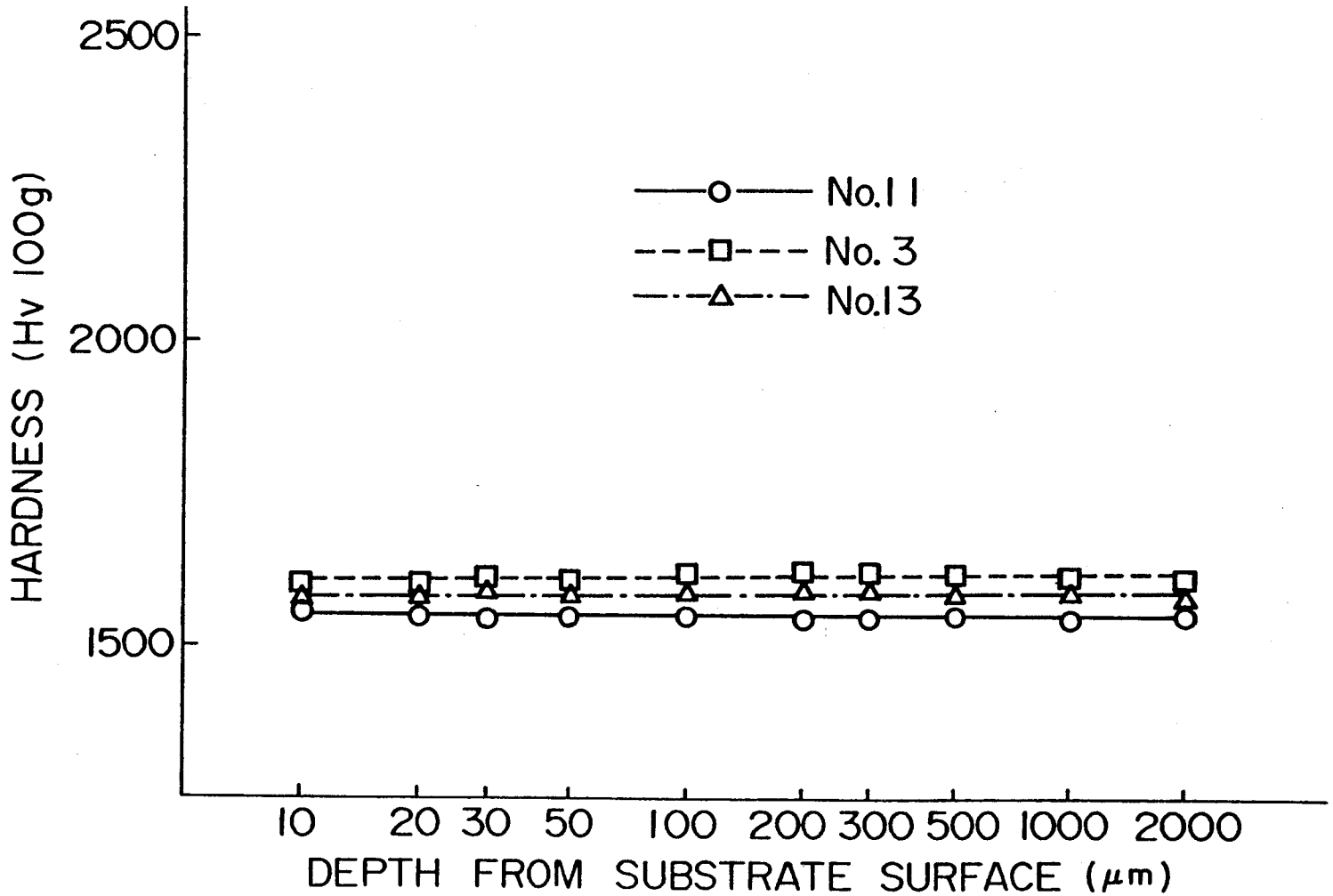
FIG. 2 is a graphical representation similar to FIG. 1, but showing comparative blade members.

Moreover, as to the surface coated blade members 3, 11 and 13 of the invention and the comparative blade members 3, 11 and 13, the hardness distribution was measured for the portion from the substrate surface to the depth of 2 mm. The results are shown in FIGS. 1 and 2. The hardness of the portion from the substrate surface to the depth of less than 10 μm could not be measured due to the size of Vickers indentation, so that only the hardness distribution from the depth of 10 μm to the depth of 2 mm is shown. As will be seen from the results, the portion having the maximum hardness should exist between the substrate surface and a depth of 10 μm for each of the blade members 3 and 11 of the invention. In the blade member 13 of the invention, the hardest portion existed at a portion of a depth near 20 μm. On the other hand, in the comparative blade members 3, 11 and 13, no distinct maximum hardness was observed.

Subsequently, cutting inserts having ISO standards of CNMG 120408 were prepared using the above blade members 1 to 14 of the invention and comparative blade members 1 to 14. In order to evaluate wear resistance characteristics, each insert was then subjected to a high-speed cutting test under the following conditions:

Workpiece: round bar of steel (JIS.SCM415; Brinell Hardness: 140)
Cutting speed: 300 m/minute
Feed rate: 0.2 mm/revolution
Depth of cut: 1.0 mm
Cutting time: 30 minutes In this test, the flank wear width for the cutting edge was measured, and the results are set forth in Tables 7 and 8.

Furthermore, in order to evaluate fracture resistance characteristics, the above cutting inserts were subjected to a high-speed interrupted cutting test under the following conditions:

Workpiece: grooved round bar of steel (JIS.SCM440; Brinell Hardness: 220)
Cutting speed: 220 m/minute
Feed rate: 0.18 mm/revolution
Depth of cut: 1.0 mm
Cutting time: 3 minutes In this test, the number of inserts subjected to fracture per tested inserts was determined. The results are again shown in Tables 7 and 8.

As will be seen from the results shown in Tables 1 to 9, in the surface coated blade members 1 to 14 of the invention, which were obtained by the sintering operation involving introducing nitrogen when the temperature is elevated in the range of 1,100° to 1,400° C., regulating the amount of nitrogen so as to form an atmosphere which denitrifies the surface portion of the sintered product, and carrying out the last stage of the sintering and the cooling step in vacuum, the hardness is greater at the surface portion of the substrate than at the interior portion of the substrate. The blade members of this construction exhibit less flank wear width in the continuous cutting operations and are less susceptible to fracture in the interrupted cutting operation when compared with comparative blade members 1 to 14, each of which comprises a substrate surface portion having a hardness generally equal to that of the interior portion.

EXAMPLE 2

The cermet substrate K of the invention and the comparative cermet substrate k of Example 1 were shaped into inserts having ISO standards of TNGA 160408. Then, a hard coating composed of TiN(0.5 μm)-TiCN(3 μm)-TiN(0.5 μm) was formed thereon to provide surface coated blade members 15 to 19 of the invention and a comparative blade member 15.

As to each blade member thus formed, the Vickers hardness (load: 100 g) was measured for the surface portion of 20 μm in depth from the surface and the interior portion of 1 mm in depth from the surface. The results are shown in Table 10.

Subsequently, in order to evaluate the wear and fracture resistances, the resulting blade members were subjected to the same cutting tests as in Example 1. The results are set forth in Table 10.

As will be seen from Table 10, in each of the surface coated blade members 15 to 19 of the invention, the surface portion at a depth of 20 μm has a hardness greater than the interior portion at a depth of 1 mm, while in the comparative blade member 15, the hardness is equal both at the surface portion and the interior portion. Furthermore, even though a part of the surface portion of the substrate is ground, the surface coated blade members 15 to 19 of the invention exhibit less flank wear width in the continuous cutting operation when compared with the comparative blade member 15.

TABLE 1

| | | Blend composition (% by weight) | | | | | | | | | | |
|---|---|---|---|---|---|---|---|---|---|---|---|---|
| | | TiCN | TiC | TiN | TaC | NbC | WC | $Mo_2C$ | VC | Co | Ni | Other |
| Cermet substrate | A | 67 | — | — | 9 | — | 9 | 9 | — | — | 6 | — |
| | B | 74 | — | — | 9 | — | 9 | — | — | — | 8 | — |
| | C | 58 | — | — | 9 | 1 | 9 | 9 | — | 9 | 5 | — |
| | D | 59 | — | — | 9 | — | 14 | — | — | 9 | 9 | — |
| | E | — | 32 | 27 | 5 | 3 | 15 | 10 | 2 | 9 | 5 | NbN:2 |
| | F | — | 28.8 | 29 | 9 | — | 10 | 9 | — | 9 | 5 | Al:0.2 |
| | G | 57 | — | — | 5 | — | 13 | 7 | — | — | 14 | TaN:4 |
| | H | — | 29 | 34 | 9 | 1 | 9 | 9 | — | 9 | 5 | — |
| | I | 48 | — | 10 | 6 | 4 | 11 | 7 | — | 7 | 7 | — |
| | J | — | 27 | 27 | 9 | 1 | 13 | 9 | — | 9 | 5 | — |
| | K | 63 | — | — | 9 | 1 | 13 | 9 | — | 9 | 5 | — |
| | L | 58 | — | — | 9 | 1 | 9 | 9 | — | 9 | 5 | — |
| | M | 53 | — | 5 | 9 | 1 | 9 | 9 | — | 9 | 5 | — |
| | N | 49 | — | 9 | 9 | 1 | 9 | 9 | — | 9 | 5 | — |

TABLE 2

| | | Blend composition (% by weight) | | | | | | | | | | |
|---|---|---|---|---|---|---|---|---|---|---|---|---|
| | | TiCN | TiC | TiN | TaC | NbC | WC | $Mo_2C$ | VC | Co | Ni | Other |
| Cermet substrate | a | 67 | — | — | 9 | — | 9 | 9 | — | — | 6 | — |
| | b | 74 | — | — | 9 | — | 9 | — | — | — | 8 | — |
| | c | 58 | — | — | 9 | 1 | 9 | 9 | — | 9 | 5 | — |
| | d | 59 | — | — | 9 | — | 14 | — | — | 9 | 9 | — |
| | e | — | 32 | 27 | 5 | 3 | 15 | 10 | 2 | 9 | 5 | NbN:2 |
| | f | — | 28.8 | 29 | 9 | — | 10 | 9 | — | 9 | 5 | Al:0.2 |
| | g | 57 | — | — | 5 | — | 13 | 7 | — | — | 14 | TaN:4 |
| | h | — | 29 | 34 | 9 | 1 | 9 | 9 | — | 9 | 5 | — |
| | i | 48 | — | 10 | 6 | 4 | 11 | 7 | — | 7 | 7 | — |
| | j | — | 27 | 27 | 9 | 1 | 13 | 9 | — | 9 | 5 | — |
| | k | 63 | — | — | 9 | 1 | 13 | 9 | — | 9 | 5 | — |
| | l | 58 | — | — | 9 | 1 | 9 | 9 | — | 9 | 5 | — |
| | m | 53 | — | 5 | 9 | 1 | 9 | 9 | — | 9 | 5 | — |
| | n | 49 | — | 9 | 9 | 1 | 9 | 9 | — | 9 | 5 | — |

TABLE 3

| | | Temperature of $N_2$ to be introduced (°C.) | $N_2$ partial pressure (Torr) | Sintering temperature (°C.) | Holding time for sintering (min) | Switching time to vacuum* (min) | Degree of vacuum during sintering and cooling (Torr) |
|---|---|---|---|---|---|---|---|
| Cermet substrate | A | 1300 | 20 | 1570 | 90 | 80 | 0.1 |
| | B | 1300 | 15 | 1570 | 90 | 80 | 0.1 |
| | C | 1300 | 30 | 1530 | 90 | 60 | 0.5 |
| | D | 1300 | 15 | 1490 | 60 | 40 | 0.1 |
| | E | 1200 | 30 | 1530 | 90 | 60 | 0.2 |
| | F | 1150 | 50 | 1530 | 90 | 80 | 0.2 |
| | G | 1300 | 15 | 1530 | 90 | 80 | 0.2 |
| | H | 1200 | 100 | 1530 | 90 | 70 | 0.1 |
| | I | 1350 | 30 | 1550 | 90 | 80 | 0.2 |
| | J | 1100 | 50 | 1530 | 90 | 70 | 0.1 |
| | K | 1300 | 40 | 1550 | 90 | 80 | 0.1 |
| | L | 1300 | 30 | 1530 | 90 | 80 | 0.2 |
| | M | 1300 | 40 | 1500 | 90 | 80 | 0.2 |

TABLE 3-continued

| | | Temperature of $N_2$ to be introduced (°C.) | $N_2$ partial pressure (Torr) | Sintering temperature (°C.) | Holding time for sintering (min) | Switching time to vacuum* (min) | Degree of vacuum during sintering and cooling (Torr) |
|---|---|---|---|---|---|---|---|
| | N | 1300 | 50 | 1550 | 90 | 80 | 0.2 |

*denotes time from the start of the holding operation

TABLE 4

| | | Temperature of $N_2$ to be introduced (°C.) | $N_2$ partial pressure (Torr) | Sintering temperature (°C.) | Holding time for sintering (min) | Switching time to vacuum (min) | Degree of vacuum during sintering and cooling (Torr) |
|---|---|---|---|---|---|---|---|
| Cermet substrate | a | — | 0.01 (vacuum) | 1550 | 90 | — | 0.01 |
| | b | — | 0.01 (vacuum) | 1550 | 90 | — | 0.01 |
| | c | 1300 | 120 | 1530 | 90 | — | $N_2$ 30 |
| | d | 1300 | 140 | 1490 | 60 | — | $N_2$ 40 |
| | e | 1200 | 160 | 1530 | 90 | — | $N_2$ 50 |
| | f | 1150 | 200 | 1530 | 90 | — | $N_2$ 60 |
| | g | 1300 | 140 | 1530 | 90 | — | $N_2$ 40 |
| | h | 1200 | 200 | 1530 | 90 | — | $N_2$ 60 |
| | i | 1350 | 160 | 1530 | 90 | — | $N_2$ 50 |
| | j | 1100 | 200 | 1530 | 90 | — | $N_2$ 60 |
| | k | 1300 | 160 | 1550 | 90 | — | $N_2$ 50 |
| | l | 1300 | 160 | 1530 | 90 | — | $N_2$ 50 |
| | m | 1300 | 160 | 1500 | 90 | — | $N_2$ 50 |
| | n | 1300 | 200 | 1550 | 90 | — | $N_2$ 60 |

TABLE 5

| | | Substrate | Hard coating** ←Lower layer Upper layer→ | Coating method |
|---|---|---|---|---|
| Blade members of the invention | 1 | A | TiN(2) | PVD |
| | 2 | B | TiCN(2)-TiN(1) | PVD |
| | 3 | C | TiN(0.5)-TiC(1)-TiCN(1)-TiN(0.5) | CVD |
| | 4 | D | TiC(2)-TiCNO(1)-$Al_2O_3$(1) | CVD |
| | 5 | E | TiC(1)-TiCN(1)-TiN(1) | CVD |
| | 6 | F | Ti(0.2)-(Ti, Al)N(3)-TiN(0.5) | PVD |
| | 7 | G | TiN(0.5)-(Ti, Al)N(2)-TiN(0.5) | PVD |
| | 8 | H | Ti(0.2)-TiN(4) | PVD |
| | 9 | I | TiN(0.5)-TiCN(2)-TiN(0.5) | PVD |
| | 10 | J | TiN(0.5)-TiCN(2)-TiN(0.5) | PVD |
| | 11 | K | TiN(0.5)-TiCN(2)-TiN(0.5) | PVD |
| | 12 | L | TiN(0.5)-TiCN(3)-TiN(0.5) | CVD |
| | 13 | M | TiN(0.5)-TiCN(3)-TiN(0.5) | CVD |
| | 14 | N | Ti(0.2)-TiN(1)-TiCN(2)-TiN(0.5) | PVD |

**Value in parentheses indicates thickness (μm) of each layer

TABLE 6

| | | Substrate | Hard coating** ←Lower layer Upper layer→ | Coating method |
|---|---|---|---|---|
| Comparative blade members | 1 | a | TiN(2) | PVD |
| | 2 | b | TiCN(2)-TiN(1) | PVD |
| | 3 | c | TiN(0.5)-TiC(1)-TiCN(1)-TiN(0.5) | CVD |
| | 4 | d | TiC(2)-TiCNO(1)-$Al_2O_3$(1) | CVD |
| | 5 | e | TiC(1)-TiCN(1)-TiN(1) | CVD |
| | 6 | f | Ti(0.2)-(Ti, Al)N(3)-TiN(0.5) | PVD |
| | 7 | g | TiN(0.5)-(Ti, Al)N(2)-TiN(0.5) | PVD |
| | 8 | h | Ti(0.2)-TiN(4) | PVD |
| | 9 | i | TiN(0.5)-TiCN(2)-TiN(0.5) | PVD |
| | 10 | j | TiN(0.5)-TiCN(2)-TiN(0.5) | PVD |
| | 11 | k | TiN(0.5)-TiCN(2)-TiN(0.5) | PVD |
| | 12 | l | TiN(0.5)-TiCN(3)-TiN(0.5) | CVD |
| | 13 | m | TiN(0.5)-TiCN(3)-TiN(0.5) | CVD |
| | 14 | n | Ti(0.2)-TiN(1)-TiCN(2)-TiN(0.5) | PVD |

**Value in parentheses indicates thickness (μm) of each layer

TABLE 7

| | | Cermet substrate | Vickers hardness: Surface portion at depth of 20 μm from the substrate surface | Vickers hardness: Interior portion at depth of 1 mm from the substrate surface | Continuous cutting Flank wear width (mm) | Interrupted cutting Fractured inserts/ tested inserts |
|---|---|---|---|---|---|---|
| Blade members of the invention | 1 | A | 2450 | 1930 | 0.12 | 4/10 |
| | 2 | B | 2330 | 1860 | 0.16 | 3/10 |
| | 3 | C | 2310 | 1630 | 0.17 | 1/10 |
| | 4 | D | 2310 | 1520 | 0.18 | 4/10 |
| | 5 | E | 2230 | 1700 | 0.22 | 3/10 |
| | 6 | F | 2270 | 1600 | 0.20 | 0/10 |
| | 7 | G | 2280 | 1580 | 0.19 | 2/10 |
| | 8 | H | 2200 | 1720 | 0.24 | 0/10 |
| | 9 | I | 2210 | 1640 | 0.23 | 3/10 |
| | 10 | J | 2240 | 1580 | 0.21 | 0/10 |
| | 11 | K | 2350 | 1570 | 0.15 | 0/10 |
| | 12 | L | 2320 | 1630 | 0.17 | 1/10 |
| | 13 | M | 2260 | 1630 | 0.17 | 1/10 |
| | 14 | N | 2300 | 1600 | 0.18 | 0/10 |

TABLE 8

| | | Cermet substrate | Vickers hardness: Surface portion at depth of 20 μm from the substrate surface | Vickers hardness: Interior portion at depth of 1 mm from the substrate surface | Continuous cutting Flank wear width (mm) | Interrupted cutting Fractured inserts/ tested inserts |
|---|---|---|---|---|---|---|
| Comparative Blade members | 1 | a | 1830 | 1850 | 0.30 | 10/10 |
| | 2 | b | 1780 | 1790 | 0.38 | 10/10 |
| | 3 | c | 1610 | 1620 | 0.45 | 7/10 |
| | 4 | d | 1530 | 1520 | 0.62 | 7/10 |
| | 5 | e | 1680 | 1680 | 0.48 | 9/10 |
| | 6 | f | 1600 | 1600 | 0.44 | 7/10 |
| | 7 | g | 1570 | 1560 | 0.58 | 8/10 |
| | 8 | h | 1700 | 1700 | 0.45 | 8/10 |
| | 9 | i | 1620 | 1620 | 0.52 | 10/10 |
| | 10 | j | 1560 | 1570 | 0.60 | 7/10 |
| | 11 | k | 1550 | 1550 | 0.62 | 7/10 |
| | 12 | l | 1590 | 1600 | 0.45 | 8/10 |
| | 13 | m | 1580 | 1590 | 0.47 | 8/10 |
| | 14 | n | 1600 | 1600 | 0.55 | 7/10 |

TABLE 9

| | Contents of constituents (% by weight) | | | | | |
|---|---|---|---|---|---|---|
| | Co | | Ni | | W | |
| | Surface portion | Interior portion | Surface portion | Interior portion | Surface portion | Interior portion |
| Blade members of the invention | | | | | | |
| 3 | 4.9 | 8.5 | 2.7 | 4.7 | 13.2 | 8.3 |
| 11 | 4.8 | 8.4 | 2.6 | 4.6 | 19.5 | 12.3 |
| 13 | 4.8 | 8.4 | 2.7 | 4.7 | 13.3 | 8.3 |
| Comparative blade members | | | | | | |
| 3 | 9.1 | 8.9 | 5.1 | 5.0 | 8.8 | 8.9 |
| 11 | 9.1 | 9.0 | 5.0 | 4.9 | 12.9 | 13.1 |
| 13 | 9.0 | 8.9 | 4.9 | 4.9 | 9.0 | 9.0 |

TABLE 10

| | | Ground surface and amount: Flank (μm) | Ground surface and amount: Rake surface (μm) | Vickers hardness: Surface portion at depth of 20 μm from the substrate surface | Vickers hardness: Interior portion at depth of 1 mm from the substrate surface | Continuous cutting Flank wear width (mm) | Interrupted cutting Fractured inserts/ tested inserts |
|---|---|---|---|---|---|---|---|
| Blade members of the invention | 15 | 75 | none | 1880 | 1570 | 0.21 | 0/10 |
| | 16 | 120 | none | 1680 | 1570 | 0.25 | 0/10 |
| | 17 | none | 50 | 1990 | 1570 | 0.19 | 0/10 |
| | 18 | none | 100 | 1720 | 1570 | 0.20 | 0/10 |
| | 19 | 50 | 50 | 1990 | 1570 | 0.22 | 0/10 |
| Comparative blade members | 15 | 500 | 500 | 1550 | 1550 | 0.37 | 0/10 |

What is claimed is:

1. A surface coated cermet blade member comprising:

a substrate of cermet which consists, apart from unavoidable impurities, of a binder phase of 5 to 30% by weight of at least one element selected from the group consisting of cobalt, nickel, iron and aluminum, and a hard dispersed phase of a balance carbo-nitride of metals, said metals being titanium, tungsten and at least one additional metal selected from the group consisting of tantalum, niobium, vanadium, zirconium, molybdenum and chromium, said substrate including a surface portion and an interior portion, said surface portion having a depth of less than 1 mm from a surface thereof, said surface portion further consisting of a binder phase enriched layer of less than 10 μm depth from said surface and a hard dispersed phase enriched layer; said binder phase enriched layer including said binder phase at higher concentration than that of said interior portion, said hard dispersed phase enriched layer including said binder phase in lower concentration than that of said interior portion, said hard dispersed phase enriched layer having greater hardness than said interior portion; and a hard coating of an average thickness of 0.5 to 10 μm deposited on said substrate, said hard coating being composed of at least one coating layer formed of a coating compound selected from the group consisting of TiX and $Al_2O_3$, where X denotes at least one element selected from the group consisting of carbon, nitrogen, oxygen and boron.

2. A surface coated blade member according to claim 1, wherein said binder phase is present in said substrate in an amount from 10 to 20% by weight.

3. A surface coated blade member according to claim 1, in which said binder phase is composed of at least one element selected from the group consisting of cobalt and nickel.

4. A surface coated blade member according to claim 3, wherein said binder phase is present in said substrate in an amount from 10 to 20% by weight.

5. A surface coated blade member according to claim 1, wherein said binder phase enriched layer includes a surface consisting essentially of said binder phase, with a thickness of 0.5 to 3 μm, which is exuded on said surface of said substrate.

6. A surface coated blade member according to claim 1, said surface portion of said substrate includes a hard dispersed phase consisting essentially of core structures free from surrounding structures.

7. A surface coated blade member according to claim 1, in which maximum Vickers hardness in said surface portion is no less than 2000 while Vickers hardness in said interior portion is less than 2000.

8. A surface coated blade member according to claim 1, in which the hardness of said substrate is greatest at a depth of 100 μm from said surface of said surface portion.

9. A surface coated blade member according to claim 1, wherein said substrate has a rake surface, said binder phase enriched layer in said rake surface being ground prior to said deposition of said hard coating, and said hard coating being deposited directly on said hard dispersed phase enriched layer in said rake surface.

10. A surface coated blade member according to claim 1, wherein said substrate has a flank, said binder phase enriched layer in said flank being ground prior to said deposition of said hard coating, and said hard coating being deposited directly on said hard dispersed phase enriched layer in said flank.

11. A surface coated blade member according to claim 1, in which said at least one coating layer of said hard coating is a chemical vapor deposited layer of at least one compound selected from the group consisting of (TiC, TiN and TiCN).

12. A surface coated blade member according to claim 1, in which said at least one coating layer of said hard coating is a physical vapor deposited layer of at least one compound selected from the group consisting of (TiC, TiN and TiCN).

13. A surface coated blade member according to claim 12, in which said hard coating is composed of a plurality of said at least one coating layers, the layer adjacent said substrate being formed of titanium.

14. A surface coated blade member according to claim 12, in which said hard coating further includes a (Ti,Al)N coating layer.

15. A surface coated blade member according to claim 1, in which the average thickness of said hard coating is from 2 to 10 μm.

16. A surface coating blade member according to claim 11, in which the average thickness of said hard coating is from 2 to 10 μm.

17. A surface coated blade member according to claim 12, in which the average thickness of said hard coating is from 2 to 10 μm.

18. A surface coated cermet blade member comprising:

a substrate of cermet which consists, apart from unavoidable impurities, of a binder phase of 5 to 30% by weight of at least one element selected from the group consisting of cobalt, nickel, iron and aluminum, and a hard dispersed phase of a balance carbo-nitride of metals, said metals being titanium, tungsten and at least one additional metal selected from the group consisting of tantalum, niobium, vanadium, zirconium, molybdenum and chromium, said substrate including a surface portion and an interior portion, said surface portion having a depth of less than 1 mm from a surface thereof, and an interior portion, said surface portion consisting of a hard dispersed phase enriched layer including said binder phase at a lower concentration than said interior portion and a hard dispersed phase at a higher concentration than that of said interior portion, said hard dispersed phase enriched layer having greater hardness than said interior portion; and a hard coating of an average thickness of 0.5 to 20 μm deposited on said substrate, said hard coating being composed of at least one coating layer formed of a coating compound selected from the group consisting of TiX and $Al_2O_3$, where X denotes at least one element selected from the group consisting of carbon, nitrogen, oxygen and boron.

* * * * *